US010573431B2

(12) United States Patent
Lee et al.

(10) Patent No.: US 10,573,431 B2
(45) Date of Patent: Feb. 25, 2020

(54) COMMUNICATION CABLE

(71) Applicant: LS CABLE & SYSTEM LTD., Anyang-si, Gyeonggi-do (KR)

(72) Inventors: Woo Kyoung Lee, Suwon-si (KR); Jung Jin Kim, Gumi-si (KR); Tae Seong Kim, Seongnam-si (KR); Young Il Cho, Osan-si (KR)

(73) Assignee: LS CABLE & SYSTEM LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 16/326,860

(22) PCT Filed: Jan. 25, 2017

(86) PCT No.: PCT/KR2017/000908
§ 371 (c)(1),
(2) Date: Feb. 20, 2019

(87) PCT Pub. No.: WO2018/038335
PCT Pub. Date: Mar. 1, 2018

(65) Prior Publication Data

US 2019/0214162 A1 Jul. 11, 2019

(30) Foreign Application Priority Data

Aug. 24, 2016 (KR) ..... 10-2016-0107598
Jan. 25, 2017 (KR) ..... 10-2017-0011936

(51) Int. Cl.
*H01B 11/00* (2006.01)
*H01B 11/06* (2006.01)
(Continued)

(52) U.S. Cl.
CPC ..... *H01B 11/005* (2013.01); *H01B 11/002* (2013.01); *H01B 11/04* (2013.01); *H01B 11/06* (2013.01); *H01B 7/184* (2013.01)

(58) Field of Classification Search
None
See application file for complete search history.

(56) References Cited

U.S. PATENT DOCUMENTS 1,389,143 A * 8/1921 Kempton ..... B29C 53/566 138/141
2,204,737 A * 6/1940 Swallow ..... H01B 11/1834 174/28
(Continued)

FOREIGN PATENT DOCUMENTS

KR 1020070064216 A 6/2007
KR 1020110081748 A 7/2011
(Continued)

OTHER PUBLICATIONS

KR20120047190_English_Translation_Description. Espacenet. (Year: 2012).*
(Continued)

*Primary Examiner* — Timothy J Thompson
*Assistant Examiner* — Muhammed Azam
(74) *Attorney, Agent, or Firm* — K&L Gates LLP

(57) ABSTRACT

A communication cable includes a cable core including a plurality of pairs of wires, each of the pairs of wires being formed by spirally twisting two wires including conductors covered with an insulator, and an external jacket configured to cover an outer side of the cable core, where the external jacket includes a plurality of support arms to prevent contact between the cable core and an inner surface of the external jacket and to secure a separation space in a radial direction, the plurality of support arms being integrally formed with the external jacket, and each of the plurality of support arms including a connection part connected to the inner surface of the external jacket and a support part having an increased width at an end portion of the connection part to support the
(Continued)

cable core, thereby enabling the communication cable to satisfy a standard of Cat.6A or higher.

20 Claims, 4 Drawing Sheets

(51) Int. Cl.
*H01B 11/04* (2006.01)
*H01B 7/18* (2006.01)

(56) References Cited

U.S. PATENT DOCUMENTS 5,789,711 A * 8/1998 Gaeris ..... H01B 11/02 174/113 C
5,952,615 A * 9/1999 Prudhon ..... H01B 11/06 174/113 C
6,365,836 B1 * 4/2002 Blouin ..... H01B 11/04 174/113 C
6,787,697 B2 * 9/2004 Stipes ..... H01B 11/04 174/36
6,826,338 B2 * 11/2004 Matsuyama ..... G02B 6/4489 385/105
7,145,080 B1 * 12/2006 Boisvert ..... H01B 11/06 174/110 R
7,208,683 B2 * 4/2007 Clark ..... H01B 11/04 174/110 R
7,271,344 B1 * 9/2007 Stutzman ..... H01B 7/184 174/113 R
7,592,550 B2 * 9/2009 Stutzman ..... 174/113 C
7,705,244 B2 * 4/2010 Fok ..... H01B 11/06 174/113 AS
7,772,494 B2 * 8/2010 Vexler ..... H01B 11/06 174/113 C
8,895,858 B2 * 11/2014 Heffner ..... H01B 11/06 174/116
10,031,301 B2 * 7/2018 Glew ..... G02B 6/4416
10,032,542 B2 * 7/2018 Glew ..... H01B 7/295
10,121,571 B1 * 11/2018 McNutt ..... H01B 11/06
10,347,399 B2 * 7/2019 Kaczmarski ..... H01B 3/441
2004/0055771 A1 * 3/2004 Wiekhorst ..... H01B 11/002 174/15.1
2004/0055779 A1 * 3/2004 Wiekhorst ..... H01B 7/0233 174/117 AS
2004/0256139 A1 * 12/2004 Clark ..... H01B 11/002 174/110 R
2006/0118322 A1 * 6/2006 Wiekhorst ..... H01B 7/0275 174/110 R
2006/0162949 A1 * 7/2006 Bolouri-Saransar ... H01B 11/04 174/113 R
2006/0169479 A1 * 8/2006 Dillon ..... H01B 7/29 174/113 R
2007/0144763 A1 * 6/2007 Park ..... H01B 11/06 174/113 C
2007/0275583 A1 * 11/2007 McNutt ..... H01B 11/06 439/225
2009/0223694 A1 * 9/2009 Nordin ..... H01B 11/1008 174/34
2010/0116521 A1 * 5/2010 Nordin ..... B32B 7/12 174/113 C
2010/0175910 A1 * 7/2010 Skocypec ..... H01B 7/185 174/174
2010/0218973 A1 * 9/2010 Camp, II ..... H01B 11/06 174/113 C
2011/0168426 A1 * 7/2011 Kim ..... H01B 11/04 174/113 C
2011/0174516 A1 * 7/2011 Baeck ..... H01B 11/06 174/113 C
2011/0220390 A1 * 9/2011 Szylakowski ..... H01B 7/295 174/113 R
2012/0045186 A1 * 2/2012 Wessels, Jr. ..... H01B 11/125 385/113
2012/0318558 A1 * 12/2012 Bolouri-Saransar ... H01B 11/04 174/113 R
2013/0277090 A1 * 10/2013 Nordin ..... H01B 11/1008 174/113 C
2014/0262427 A1 * 9/2014 Brown ..... H01B 3/301 174/113 C
2018/0301245 A1 * 10/2018 Glew ..... H01B 7/423
2019/0051433 A1 * 2/2019 Kaczmarski ..... H01B 3/441
2019/0066874 A1 * 2/2019 Kaczmarski ..... H01B 7/295
2019/0214162 A1 * 7/2019 Lee ..... H01B 11/06

FOREIGN PATENT DOCUMENTS

KR 1020120047190 A 5/2012
KR 101160160 B1 6/2012

OTHER PUBLICATIONS

International Search Report for related International Application No. PCT/KR2017/000908; action dated May 11, 2018; (5 pages)
Written Opinion for related International Application No. PCT/KR2017/000908; action dated May 11, 2018; (6 pages).

* cited by examiner

COMMUNICATION CABLE

The present application is a National Stage of International Application No. PCT/KR2017/000908, filed Jan. 25, 2017, which claims priority to Korean Application No. 10-2016-0107598, filed Aug. 24, 2016 and Korean Application No. 10-2017-0011936, Filed Jan. 25, 2017, the disclosure of which are incorporated herein by reference.

TECHNICAL FIELD

The present invention relates to a communication cable capable of satisfying a communication cable standard of Cat.6A or higher without having no metal shielding layer to simplify a structure. More particularly, the present invention relates to a communication cable capable of satisfying the communication cable standard of Cat.6A or higher by minimizing interference between adjacent cables by a method of changing a structure of an external jacket without applying a metal shielding layer to cover each pair of wires or a whole cable core.

BACKGROUND ART

A UTP communication cable (or a LAN cable) is generally used for wired communication stands for an unshielded twisted pair cable. That is, a commonly used UTP communication cable is also called an unshielded pair cable or an unshielded twisted cable. In general, a UTP communication cable is a standard signal wire for use in a LAN card. The UTP communication cable may include a cable core having pairs of wires therein, and an external jacket covering the cable core to protect the cable core.

Generally, UTP communication cables may be classified into categories (abbreviated to 'Cat.') according to a transmission rate (Mbps) of a communication signal and a transmission band (MHz).

Recently, as Cat.5 or Cat.6 cables are increasingly used, optical communication has come into widespread use, and computer hardware performance has been improved. There is a growing need for higher-grade communication cables and, thus, the use of Cat.6A or Cat.7 cables is gradually increasing.

In detail, the higher a transmission speed (Mbps) via a communication cable and a transmission band (MHz) are, the higher the category of the communication cable is. A Cat.5 cable that has recently been more commonly used has a transmission rate of 100 Mbps and a transmission band of 100 MHz. A Cat.5e cable has a transmission rate of 400 Mbps and a transmission band of 100 MHz. A Cat.6 cable has a transmission rate of 1 Gbps and a transmission band of 250 MHz. A recently introduced Cat.6A class has a transmission rate of 10 Gbps and a transmission band of 500 MHz. A Cat.7 cable that is expected to be used in the near future has a transmission rate of 10 Gbps and a transmission band of 600 MHz.

In case of a communication cable supporting the speeds of Cat.6 or higher cables, a method of adding a metal shielding layer to the inside of a sheath to cover each pair of wires or a cable core is generally used to prevent mutual influence of adjacent cables, external interference, etc.

However, the method of adding a metal shielding layer to the inside of a sheath to cover each pair of wires or a cable core is disadvantageous in terms of a complicated manufacturing process and high manufacturing costs.

DETAILED DESCRIPTION OF THE INVENTION

Technical Problem

The present invention is directed to a communication cable capable of satisfying the communication cable standard of Cat.6A or higher by minimizing interference between adjacent cables by a method of changing a structure of an external jacket without applying a metal shielding layer to cover each pair of wires or a whole cable core.

Technical Solution

According to an aspect of the present invention, there may be provided a communication cable comprising: a cable core including a plurality of pairs of wires, each of the pairs of wires being formed by spirally twisting two wires including conductors covered with an insulator; and an external jacket configured to cover an outer side of the cable core, wherein the external jacket comprises separation means to prevent contact between the cable core and an inner surface of the external jacket and to secure a separation space in a radial direction, the separation means being integrally formed with the external jacket, and each including a connection part connected to the inner surface of the external jacket and a support part having an increased width at an end portion of the connection part to support the cable core.

And the separation means may be provided on the inner surface of the external jacket to be spaced apart from each other in a lengthwise direction of the communication cable. And the connection part of each of the separation means may taper toward the support part.

And at least one groove may be formed at an upper surface of the support part of each of the separation means.

And a plurality of grooves may be formed in the upper surface of the support part of each of the separation means to be spaced apart from each other.

And a width of a central groove among widths of the grooves formed in the upper surface of the support part of each of the separation means may be largest.

And the external jacket may have a thickness greater than a thickness of the connection part of each of the separation means or a depth of the groove formed in the support part.

And the support part of each of the separation means may have a partially circular-arc shape.

And the support part of each of the separation means may have a circular arc shape having an angle of 50 to 70 degrees.

And four separation means may be provided on a cross section of the external jacket at equal intervals in a circumferential direction.

And the connection parts and the support parts of the external jacket may be formed such that the communication cable satisfies a standard of Cat.6A or higher.

And according to an aspect of the present invention, there may be provided a communication cable comprising: a plurality of pairs of wires, each of the pairs of wires being formed by spirally twisting two wires including conductors covered with an insulator; an external jacket configured to cover outer sides of the pairs of wires; and a plurality of support arms configured to support the pairs of wires toward a center of the communication cable so as to prevent contact with an inner surface of the external jacket and form an empty space below support surfaces of the pairs of wires, the support arms protruding from an inner surface of the external jacket and having a cross section with a width increased toward the center of the communication cable.

And the support arms may be formed on the inner surface of the external jacket in a lengthwise direction of communication cable and at equal intervals in a circumferential direction.

And a plurality of protrusions may be formed on a support surface of each of the support arms to be spaced apart from each other in a widthwise direction of the support surface of the support arm.

And the distance between the protrusions on a central portion of the support surface may be greater than that between the protrusions on edges of the support surface.

And the sum of angles of the support surfaces of the support arms with respect to the center of the communication cable may be 200 degrees or more.

And four support arms may be provided.

And the communication cable satisfies a transmission rate of 10 Gbps or more at a transmission band of 500 MHz or more, and may have a diameter of 8.1 mm to 8.5 mm.

And four pairs of wires may be provided, and a cross-shaped separator may be provided between the four pairs of wires.

And the support arms protrude from the inner surface of the external jacket, and have a width decreased toward the center of the communication cable and increased at the support surfaces.

Advantageous Effects

A communication cable according to the present invention is capable of satisfying a communication standard of Cat.6A without additionally shielding each of the pairs of wires of a UTP communication cable or a cable core including the pairs of wires with a metal shielding layer.

The communication cable according to the present invention does not include a metal shielding layer and thus a manufacturing process is simple and an increase in manufacturing costs can be prevented while satisfying the Cat.6A standard.

In the communication cable of the present invention, a support arm provided as a separation means on an inner surface of an external jacket of the communication cable has a width increased toward a center of the cable, and thus, the cable core can be stably supported and an air layer or an empty space can be sufficiently secured in the communication cable. Accordingly, the total permittivity of the communication cable can be reduced to improve an attenuation margin, a propagation speed margin, etc. of the communication cable.

Furthermore, in the communication cable according to the present invention, the support arm is provided as a separation means on the inner surface of the external jacket of the communication cable and thus the cable core with the pairs of wires can be arranged at the center of the communication cable. Accordingly, the distance between cable cores of adjacent cables can be increased to minimize external interference between the adjacent cables.

MODE OF THE INVENTION

Hereinafter, exemplary embodiments of the present invention will be described in detail. The present invention is, however, not limited thereto and may be embodied in many different forms. Rather, the embodiments set forth herein are provided so that this disclosure will be thorough and complete, and fully convey the scope of the invention to those of ordinary skilled in the art. Throughout the specification, the same reference numbers represent the same elements.

Figure 1:
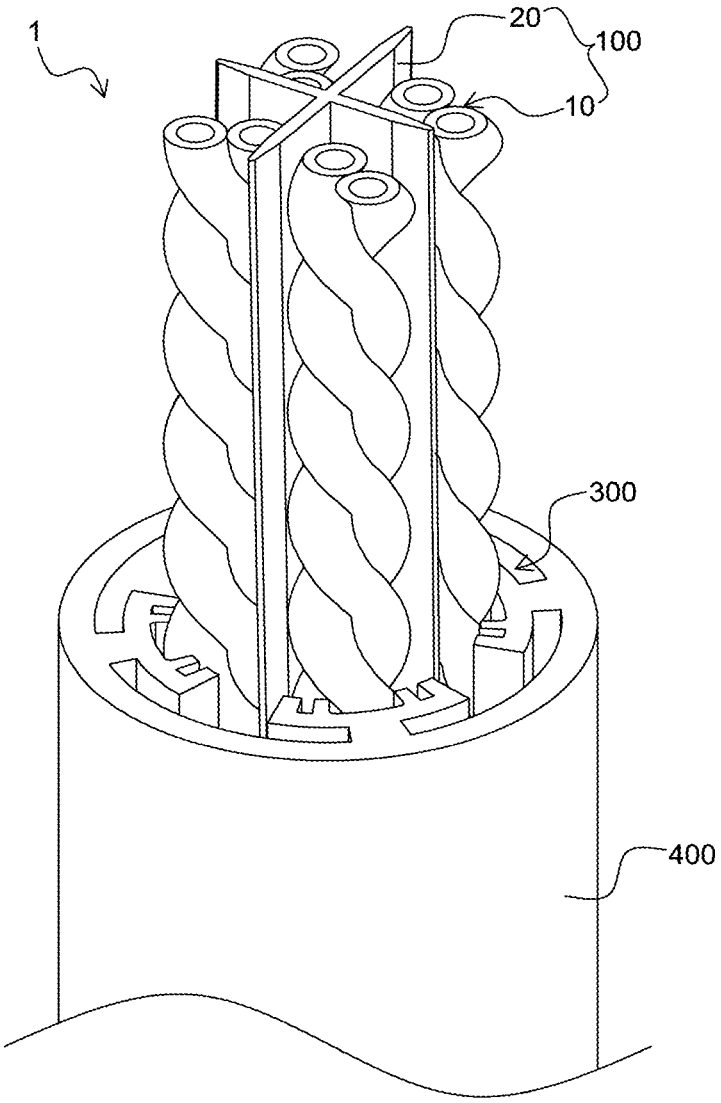
FIG. 1 is a partially cutaway perspective view of a communication cable according to the present invention.
Figure 2:
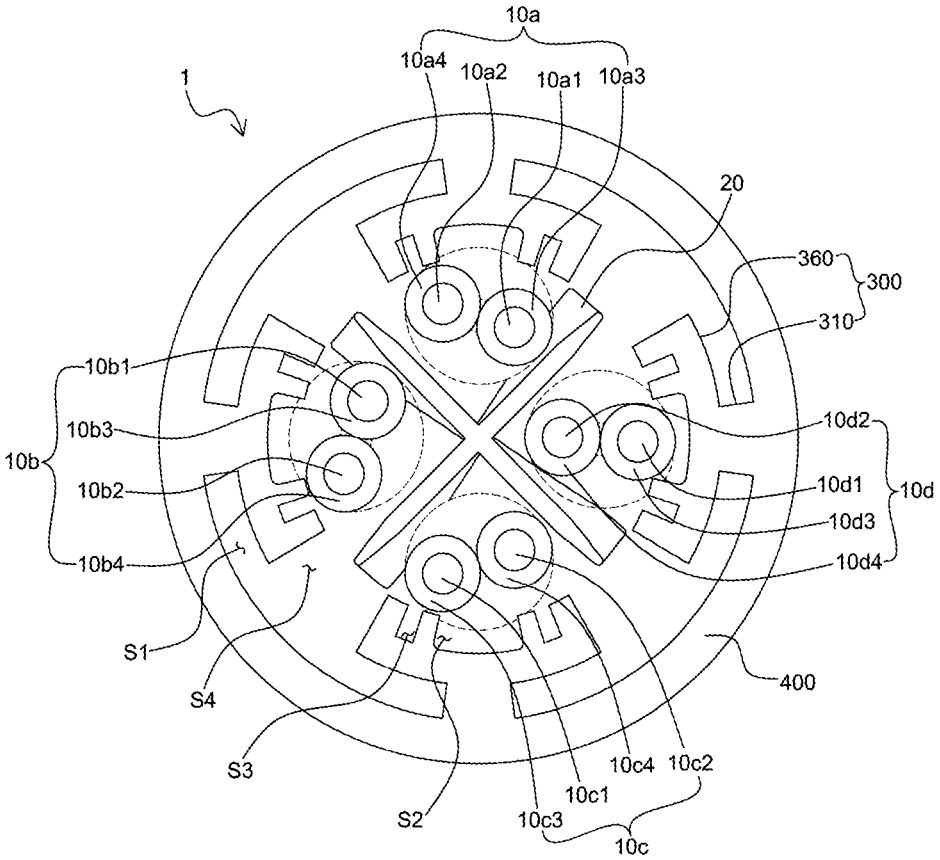
FIG. 2 is a cross-sectional view of the communication cable of FIG. 1.

FIG. 1 is a partially cutaway perspective view of a communication cable 1 according to the present invention. FIG. 2 is a cross-sectional view of the communication cable 1 of FIG. 1.

The communication cable 1, according to the present invention, includes a cable core 100 including a plurality of pairs of wires 10, each of the pairs of wires being formed by spirally twisting two wires consisting of conductors covered with an insulator; and an external jacket 400 covering an outer side of the cable core 100. The external jacket 400 includes separation means to prevent contact between inner surface of the cable core 100 and the external jacket 400 and to secure a separation space in a radial direction. The separation means are integrally formed with the external jacket 400, and each include a connection part connected to the inner surface of the external jacket 400, and a support part having an increased width at an end portion of the connection part and supporting the cable core 100. The components of the communication cable 1 will be described below.

The communication cable 1, according to the present invention, may include the cable core 100 with the plurality of pairs of wires 10. Here, each of the pairs of wires 10 is formed by spirally twisting two wires consisting of conductors covered with an insulator. Although FIGS. 1 and 2 illustrate that the communication cable 1 according to the present invention includes four pairs of wires 10, the number of pairs of wires 10 may be increased according to requirements such as a communication standard.

Each of the conductors may be formed of aluminum, copper, or an annealed copper wire material. When a diameter of a conductor is decreased, a capacitance (C) decreases and a conductor resistance increases and thus an attenuation rate increases. Accordingly, a conductor having a diameter of about 24 AWG may be generally used.

The insulator covering the conductors may be formed of a material such as low-density polyethylene (LDPE), medium-density polyethylene (MDPE), or high-density polyethylene (HDPE). In recent years, insulators having flame-retardant property have been used.

In general, insulators covering conductors may have different colors.

The four pairs of wires 10 illustrated in FIGS. 1 and 2 may form the cable core 100 such that they are spaced apart from each other by a cross-shaped separator 20.

As illustrated in the cross-sectional view of FIG. 2, the separator 20 may have a cross-shaped cross section, and may be gently twisted in the spiral form and arranged in the communication cable 1. Each of the pairs of wires 10 may be provided in one of four parts of a space in the communication cable 1 divided by the separator 20. The pairs of wires 10 may be spaced apart from each other as much as possible by the separator 20, thereby minimizing interference, etc.

That is, the separator 20 may partition the pairs of wires 10, and provide spaces in which the pairs of wires 10 are accommodated. Each of the pairs of wires 10 may be placed in one of the spaces.

The separator 20 may minimize near-end crosstalk (NEXT) which may become worse when the distances between the pairs of wires 10 are reduced. The near-end cross talk may become worse as a cable grade is increased according to the speed of communication or a frequency. Thus, when a shielding means (a metal tape or the like) is not used for each of the pairs of wires 10, a method of increasing the distances between the pairs of wires 10 may be used to reduce near-end crosstalk. The separator 20 may be used to increase the distances between the pairs of wires 10. As a communication cable grade is increased, a width and thickness of the separator 20 should be increased to increase the distances between the pairs of wires 10, thereby minimizing the near-end crosstalk (NEXT). However, the width and thickness of the separator 20 is in a trade-off relationship with the diameter of the communication cable 1.

In the present invention, a shielding layer shielding each of the pairs of wires 10 may be omitted while satisfying a required communication grade, e.g., CAT.6A or higher. Thus, as will be described later, it is preferable to secure a sufficient width and thickness of the separator 20 so as to minimize near-end crosstalk, within a range that a transmission rate of 10 Gbps or more is achieved at a transmission band of 500 MHz and the communication cable 1 has a diameter of 8.1 mm to 8.5 mm.

The external jacket 400 may be provided on the outer side of the cable core 100. The external jacket 400 serves as an exterior of the communication cable 1, and may be formed of a material such as polyethylene, polyvinyl chloride, or low smoke zero halogen or low smoke free of halogen (LSZH). Among the materials, the LSZH generates less smoke during ignition. When the LSZH is employed as a material of a sheath of a communication cable, generally required standards, such as a smoke density standard, a halogen concentration standard, and standards related to toxicity and low smoke property, are satisfied.

As described above, pairs of wires 10*a*, 10*b*, 10*c*, and 10*d* are formed by respectively covering conductors 10*a*1, 10*a*2, 10*b*1, 10*b*2, 10*c*1, 10*c*2, 10*d*1, and 10*d*2 with insulators 10*a*3, 10*a*4, 10*b*3, 10*b*4, 10*c*3, 10*c*4, 10*d*3, and 10*d*4 and then twisting each of the pairs of wires 10*a*, 10*b*, 10*c*, and 10*d*.

The pairs of wires 10*a*, 10*b*, 10*c*, and 10*d* may be twisted in different pitches, and the insulators 10*a*3, 10*a*4, 10*b*3, 10*b*4, 10*c*3, 10*c*4, 10*d*3, and 10*d*4 covering the conductors 10*a*1, 10*a*2, 10*b*1, 10*b*2, 10*c*1, 10*c*2, 10*d*1, and 10*d*2 may have different colors.

A case in which the cable core 100 of the communication cable 1 according to the present invention includes the first pair of wires 10*a* to the fourth pair of wires 10*d* will be described as an example below.

Although the communication cable 1 according to the present invention satisfies the Cat.6A or higher standard requiring a transmission speed of 10 Gbps or more at a transmission band of 500 MHz or more, a method of changing the structure of the external jacket 400 without additionally using a metal shielding layer to cover the pairs 10 of wires or the cable core 100 is employed in the communication cable 1 as illustrated in FIGS. 1 and 2.

In general, for the communication cable 1, a characteristic impedance, a propagation delay, delay skew, an attenuation, power sum near-end crosstalk (PS NEXT) loss, pair-to-pair near-end crosstalk (NEXT) loss, power sum equal-level far-end crosstalk (PS ELFEX) loss, pair-to-pair equal-level far-end crosstalk (ELFEXT) loss, return loss, etc. should be considered in terms of electrical characteristics between the pairs of wires 10 of the communication cable 1. In case of the Cat.6A or higher standard, interference between adjacent cables, e.g., electrical characteristics such as external interference or external crosstalk, should be considered, as well as electrical characteristics between the pairs of wires 10 of the communication cable 1.

In case of electrical characteristics between the pairs of wires 10 or between adjacent cables, as a UTP cable grade becomes higher, an electrical characteristics margin decreases and interference increases. Conventionally, a metal shielding layer is used to solve this problem, but a manufacturing process is complicated and manufacturing costs increase. Accordingly, in the present invention, a new structure which will be described below is proposed.

In the communication cable 1 according to the present invention, a method of securing margins of various electrical characteristics by reducing an effective permittivity $\varepsilon$ of the communication cable 1 with respect to electrical characteristics between the pairs of wires 10 is employed. In the method of reducing the effective permittivity $\varepsilon$ of the communication cable 1, a method of maximizing an empty space which is a space for accommodation of an air layer in the communication cable 1 may be considered.

Furthermore, when a metal shielding layer is not additionally used to minimize external interference, a method of increasing the distance between cable cores 100 of adjacent communication cables 1 may be used. However, it is not preferable to unlimitedly increase a diameter of each of the communication cables 1 so as to increase the distance between the cable cores 100 of adjacent communication cables 1. Thus, when external diameters of the communication cables 1 are the same, a method of arranging the cable cores 100 of the communication cables 1 at the centers of the communication cables 1 as much as possible may be considered to increase the distance between the cable cores 100 of the adjacent communication cables 1.

In the communication cable 1 according to the present invention, the size of an empty space inside the communication cable 1 is maximized through a separation means included in the external jacket 400 and having a width increased toward the center of the communication cable 1, and the cable core 100 with the pairs of wires 10 is arranged at the center of the communication cable 1.

The communication cable 1 will be described in detail with reference to FIG. 3 below.

Figure 3:
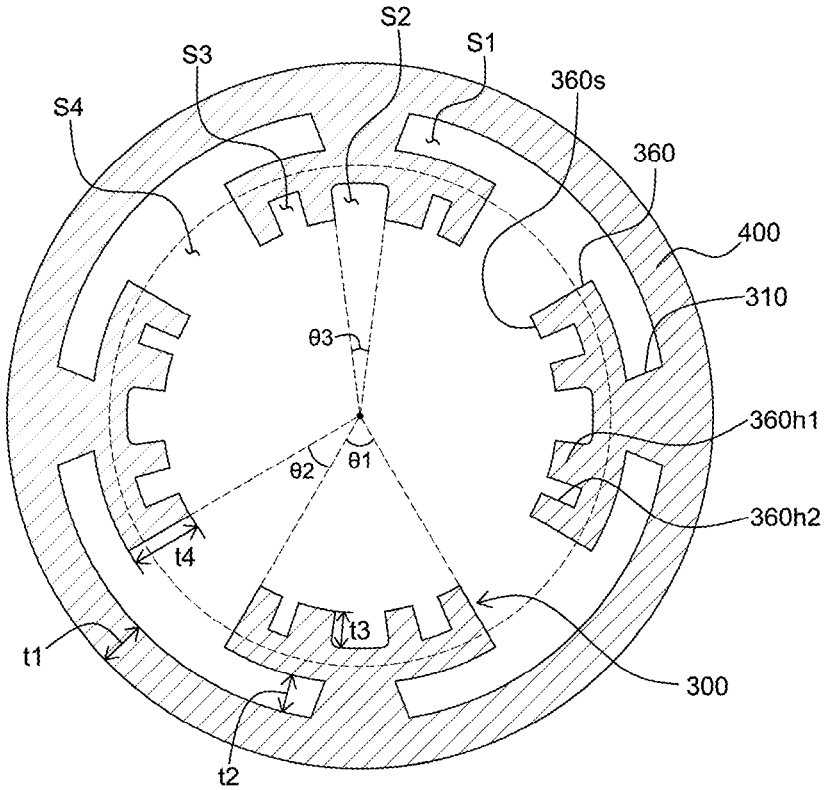
FIG. 3 is a detailed cross-sectional view of an external jacket of the communication cable according to an embodiment of the present invention illustrated in FIGS. 1 and 2.

FIG. 3 is a detailed cross-sectional view of the external jacket 400 of the communication cable 1 according to the embodiment of the present invention illustrated in FIGS. 1 and 2.

The external jacket 400 of the communication cable 1 according to the present invention may include separation means provided on an inner surface thereof and having a cross section, the width of which is increased toward the center of the communication cable 1 to prevent contact between the pairs of wires 10 and the inner surface of the external jacket 400 and to secure a separation space in a radial direction. The separation means may be in the form of a support arm 300 protruding from the inner surface of the external jacket 400.

As illustrated in FIG. 3, a plurality of support arms 300 serving as the separation means may be integrally formed with the external jacket 400 to be spaced apart from each other. In the embodiment of FIG. 3, an example in which four support arms 300 are provided along the inner surface of the external jacket 400 to be long in a lengthwise direction of the communication cable 1 and to be spaced the same distance apart from each other in a circumferential direction is illustrated.

Each of the support arms 300 serving as separation means has a width increased toward the center of the communication cable 1 from the inner surface of the external jacket 400. The support arms 300 may have, for example, a T shape, a Y shape, an inverted triangular shape, or an inverted trapezoidal shape.

In the embodiment of FIG. 3, the support arm 300 protrudes from the inner surface of the external jacket 400, and a width of a region thereof supporting the cable core 100 is increased.

In detail, the support arm 300 serving as a separation means may be integrally formed with the external jacket 400, and may include a connection part 310 connected to the inner surface of the external jacket 400 and a support part 360 having an increased width at an end portion of the connection part 310 to support the pairs of wires 10 or the cable core 100.

As illustrated in FIG. 3, a plurality of grooves **360*h*1 and 360*h*2 are formed in an upper surface 360*s* of the support arm 300. Furthermore, as illustrated in FIG. 3, the support parts 360 of the support arms 300** are spaced apart from each other to have a shape corresponding to parts of an arc of a circle.

Accordingly, a first space S1 may be formed between a lower surface of the support part 360 and the inner surface of the external jacket 400, a second surface S2 and a third surface S3 may be formed in the grooves **360*h*1 and 360*h*2 in the upper surface 360*s* of the support arm 300, and a fourth space S4 may be formed between side surfaces of support parts 360 of adjacent support arms 300**.

Due to the above structure, the cable core 100 may be supported by the support parts 360 of the support arms 300 to be stably arranged at the center of the communication cable 1, and several empty spaces may be secured in the communication cable 1.

As described above, the margins of electrical characteristics between the pairs of wires 10 may be improved by increasing empty spaces inside the communication cable 1 to reduce the effective permittivity ε, and external interference may be minimized by arranging the cable core 100 of the communication cable 1 at the center of the communication cable 1 as much as possible to increase the distances between cores of adjacent cables.

The grooves **360*h*1 and 360*h*2 in the upper surface 360*s* of the support arm 300 may be formed to be long in the lengthwise direction of the support part 360 (i.e., the lengthwise direction of the communication cable 1**).

The grooves **360*h*1 and 360*h*2 in the upper surface 360*s* of the support arm 300 are preferably formed in a size into which a specific pair of wires 10 of the cable core 100 cannot be inserted and placed, as illustrated in FIG. 2**.

That is, this is because the distance between the cable core 100 of the communication cable 1 and a cable core of the adjacent cable reduces, when a specific pair of wires 10 or specific wires of the cable core 100 are forcibly inserted into the grooves **360*h*1 and 360*h*2** to reduce external interference with an adjacent cable.

Although it is illustrated in the embodiment of FIG. 3 that three grooves **360*h*1 and 360*h*2 are formed in the upper surface 360*s* of the support part 360 of each of the separation means (or, the support arms 300?) to be spaced apart from each other, the number of the grooves 360*h*1 and 360*h*2 and widths thereof may be increased or decreased according to the number of support arms 300, the widths of the support parts 360, the external diameters of the pairs of wires 10, pitches of the wires 10**, etc.

Since the plurality of support arms 300 are provided, the plurality of support parts 360 have a shape corresponding to parts of an arc of a circle which are spaced apart from each other. The fourth space S4 is secured in a region in which the support parts 360 are spaced apart from each other but the number of empty spaces is relatively insufficient in a radial direction passing through the connection parts 310. Thus, a width of a central groove **360*h*1 among the plurality of grooves 360*h*1 and 360*h*2 formed in the upper surface 360*s* of the support part 360** may be set to be largest, thereby minimizing a deviation in an empty space in each region in the radial direction.

The connection part 310 of the support arm 300 serving as a separation means may taper toward the support part 360. Due to the above structure, it is possible to secure the restoring flexibility (or elasticity) of the support part 360 and prevent the connection part 310 from being bent, thereby stably supporting the cable core 100.

The structure of the connection part 310 of the separation means which tapers toward the support part 360 may be achieved by configuring the connection part 310 to have side surfaces oriented in the radial direction.

In addition, as illustrated in FIG. 3, not only the side surfaces of the connection part 310 but also side surfaces of the support part 360 and side surfaces of the inside of each of the grooves **360*h*1 and 360*h*2 formed in the support part 360 may be set to be oriented in the radial direction to face the center of the communication cable 1**.

Due to the above structure, each of the grooves **360*h*1 and 360*h*2 formed in the support part 360 has a narrow entrance and a wide interior, thereby maximizing empty spaces inside the communication cable 1 and preventing wire, etc. from being placed inside the grooves 360*h*1 and 360*h*2**.

In relation to the external jacket 400 of the communication cable 1 according to the present invention, it was found that an empty space inside the communication cable was maximized and the cable core 100 was stably provided at the center of the communication cable 1, thereby satisfying electrical characteristics between the pairs of wires 10 and electrical characteristics related to external interference which are required in the Cat.6A standard, when a first angle θ1 which is an angle θ1 of an arc of a circle corresponding to the support part 360 of each of the support arms 300 was about 50 to 70 degrees, a second angle θ2 which is an angle θ2 of an arc of a circle corresponding to the distance between the support parts 360 was about 20 to 40 degrees, and a third angle θ3 which is an angle θ3 of an arc of a circle corresponding to the central groove **360*h*1 among the grooves 360*h*1 and 360*h*2 formed in the upper surface 360*s* of the support part 360** was about 5 to 15 degrees.

In the embodiment of FIG. 3, the first angle θ1 is about 60 degrees, the second angle θ2 is about 30 degrees, and the third angle θ3 is about 10 degrees.

In relation to a thickness of each internal component of the external jacket 400, a thickness t1 of the external jacket 400, a thickness t2 of the connection part 310 of the support arm 300, a depth t3 of the grooves 360h1 and 360h2 formed in the support part 360, and a total thickness t4 of the support part 360 may be determined according to a total diameter of the communication cable 1.

It was experimentally found that the thickness t2 of the connection part 310 of the support arm 300 and the depth t3 of the grooves 360h1 and 360h2 formed in the support part 360 may correspond to each other, the thickness t1 of the external jacket 400 may be greater than the thickness t2 of the connection part 310 of the support arm 300 and the depth t3 of the grooves 360h1 and 360h2 formed in the support part 360, and the thickness t1 of the external jacket 400 is preferably less than the total thickness t4 of the support part 360.

If the thickness t1 of the external jacket 400 is less than the thickness t2 of the connection part 310 of the support arm 300, the external jacket 400 may be easily deformed by an external force even when the cable core 100 is stably supported by the connection part 310.

When the depth t3 of the grooves 360h1 and 360h2 formed in the support part 360 are set to be large, the pairs of wires 10 of or the wires of the cable core 100 may be placed in a specific groove among the grooves 360h1 and 360h2. Thus, a height (which is the same as the depth t3) of a wall provided between these grooves to support the pairs of wires 10 or the wires should be limited to prevent the wall from being warped or dented, thereby blocking the wires or the pairs of wires 10 from being inserted into the grooves.

Accordingly, it was concluded that the thickness t1 of the external jacket 400, the depth t3 of the grooves 360h1 and 360h2 of the support part 360, or the thickness t2 of the connection part 310 should be appropriately determined within a permissible range of the total diameter of the communication cable 1, such that the cable core 100 may be stably supported toward the center of the cable core 100 by the connection part 310 of each of the separation means and a specific pair of wires or a specific wire cannot be placed in the grooves 360h1 and 360h2 of the support part 360. It was experimentally concluded that the thickness t1 of the external jacket 400 is preferably within a preferable external-diameter range of 8.1 mm to 8.5 mm of a communication cable to be greater than the thickness t2 of the connection part 310 of the support arm 300 and the depth t3 of the grooves 360h1 and 360h2 of the support part 360, as will be described below.

It was found that electrical characteristics between the pairs of wires 10 and electrical characteristics related to external interference which are required in the Cat.6A standard were satisfied when the communication cable 1 according to the present invention had a diameter of about 8.1 mm to 8.5 mm, if used for a general purpose.

Figure 4:
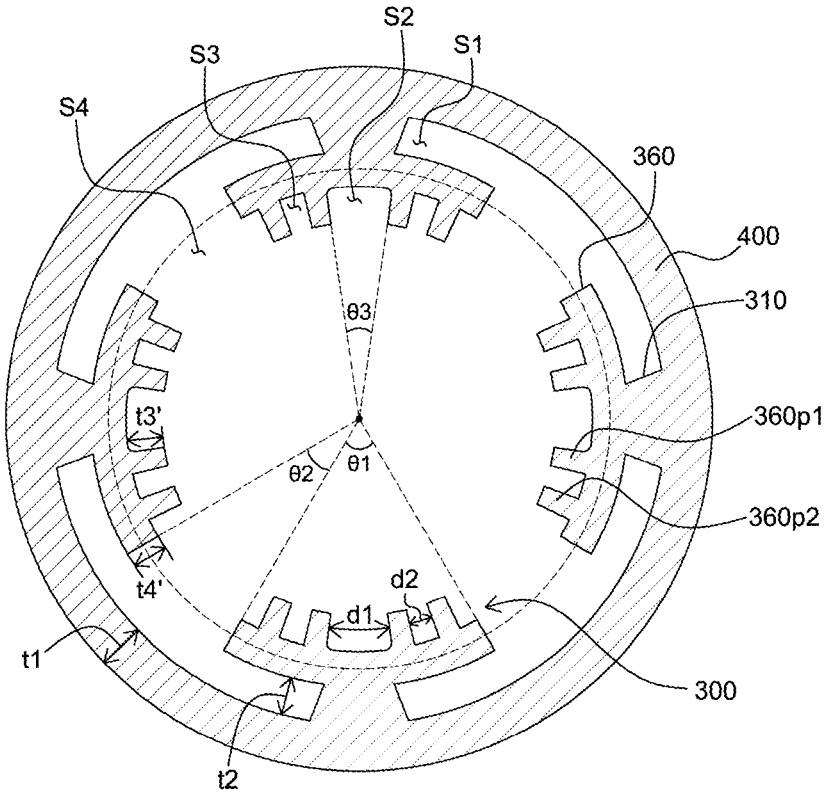
FIG. 4 is a detailed cross-sectional view of an external jacket of a communication cable according to another embodiment of the present invention.

FIG. 4 is a detailed cross-sectional view of an external jacket 400 of a communication cable 1, according to another embodiment of the present invention. A description of parts of the external jacket 400 which are the same as those of the external jacket 400 described above with reference to FIG. 3 will be omitted here. In the embodiment of FIG. 3, an example in which empty spaces area maximized by forming a plurality of grooves in the upper surface 360s of the support part 360 of the support arm 300 is illustrated, whereas in the embodiment of FIG. 4, this effect may be achieved by forming a plurality of protrusions in an upper surface of a support arm.

That is, the embodiment of FIG. 3 and the embodiment of FIG. 4 are different in terms of a method of forming empty spaces in a cable. That is, in the embodiment of FIG. 4, in order to secure empty spaces inside a cable, protrusions 360p1 and 360p2 are formed on a support surface 360s (an upper surface of a support part 360) of a support arm 300 serving as a separation means, rather than the grooves 360h1 and 360h2.

The protrusions 360p1 and 360p2 which are in contact with a cable core may be formed in an upper surface of the support arm 300 to be spaced apart from each other in a widthwise direction of the support surface 360s. In this case, the protrusions 360p1 and 360p2 may be formed to be long in a lengthwise direction of the cable, similar to the grooves 360h1 and 360h2 in the embodiment of FIG. 3.

By forming the protrusions 360p1 and 360p2, empty spaces may be secured in a cable as when the grooves 360h1 and 360h2 are formed. Similarly, the protrusions 360p1 and 360p2 are preferably formed such that a width of a space between protrusions 360p1 and 360p2 provided at a center of the support part 360 among spaces between the protrusions 360p1 and 360p2 is largest. A thickness t1 of the external jacket 400 may be greater than a thickness t2 of a connection part 310 of the support arm 300 and a thickness t3' of the protrusions 360p1 and 360p2 formed on the support part 360. It was found that the thickness t2 of the connection part 310 of the support arm 300, the thickness t3' of the protrusions 360p1 and 360p2 formed on the support part 360, and a thickness t4' of the support part 360 may be variously set according to the type and diameter of the cable.

The distance d1 between the protrusions on a central portion of the support surface may be greater than the distance d2 between the protrusions on edges of the support surface.

It was found that due to the structure of the communication cable 1 according to the present invention illustrated in FIG. 1 or 4, the Cat.6A standard was satisfied without additionally shielding either each of the pairs of wires 10 of the UTP communication cable 1 or the cable core 100 including the pairs of wires 10 with a metal shielding layer.

That is, in the communication cable 1 according to the present invention, a width of the support arm 300 provided as a separation means on the inner surface of the external jacket 400 of the communication cable 1 is increased toward the center of the communication cable 1 and thus the cable core 100 can be stably supported and an air layer or an empty space can be sufficiently secured in the communication cable 1. Accordingly, a total effective permittivity of the communication cable 1 decreases and thus an attenuation margin, a propagation speed margin, etc. of the communication cable 1 can be improved. Furthermore, due to the support arms 300 serving as separation means, the cable core 100 with the pairs of wires 10 can be arranged at a central part of the communication cable 1 to increase the distances between cable cores 100 of adjacent cables, thereby minimizing external interference between the adjacent cables.

While the present invention has been described above with respect to exemplary embodiments thereof, it would be understood by those of ordinary skill in the art that various changes and modifications may be made without departing from the technical conception and scope of the present invention defined in the following claims. Thus, it is clear that all modifications are included in the technical scope of the present invention as long as they include the components as claimed in the claims of the present invention.

The invention claimed is:

1. A communication cable comprising:

a cable core including a plurality of pairs of wires, each of the plurality of pairs of wires being formed by spirally twisting two wires including conductors covered with an insulator; and an external jacket configured to cover an outer side of the cable core, wherein the external jacket comprises a plurality of support arms to prevent contact between the cable core and an inner surface of the external jacket and to secure a separation space in a radial direction, the plurality of support arms being integrally formed with the external jacket, and each of the plurality of support arms including a connection part connected to the inner surface of the external jacket and a support part having an increased width at an end portion of the connection part to support the cable core.

2. The communication cable of claim 1, wherein the plurality of support arms are provided on the inner surface of the external jacket to be spaced apart from each other in a lengthwise direction of the communication cable.

3. The communication cable of claim 2, wherein the connection part of each of the plurality of support arms tapers toward the support part.

4. The communication cable of claim 1, wherein at least one groove is formed at an upper surface of the support part of each of the plurality of support arms.

5. The communication cable of claim 4, wherein a plurality of grooves are formed in the upper surface of the support part of each of the plurality of support arms to be spaced apart from each other.

6. The communication cable of claim 5, wherein a width of a central groove among widths of the plurality of grooves formed in the upper surface of the support part of each of the plurality of support arms is largest.

7. The communication cable of claim 4, wherein the external jacket has a thickness greater than a thickness of the connection part of each of the plurality of support arms or a depth of the at least one groove formed in the support part.

8. The communication cable of claim 2, wherein the support part of each of the plurality of support arms has a partially circular-arc shape.

9. The communication cable of claim 8, wherein the support part of each of the plurality of support arms has a circular arc shape having an angle of 50 to 70 degrees.

10. A communication cable comprising:

a plurality of pairs of wires, each of the plurality of pairs of wires being formed by spirally twisting two wires including conductors covered with an insulator;

an external jacket configured to cover outer sides of the plurality of pairs of wires; and a plurality of support arms configured to support the plurality of pairs of wires toward a center of the communication cable so as to prevent contact with an inner surface of the external jacket and form an empty space below a support surface of each of the plurality of support arms, each of the plurality of support arms protruding from the inner surface of the external jacket, wherein a width of a first end of each of the plurality of support arms is greater than a width of a second end of each of the plurality of support arms, wherein the first end is closer to the center of the communication cable than the second end, and wherein each of the plurality of support arms protrudes from the external jacket at the second end.

11. The communication cable of claim 1, wherein the cable core comprises a separator to space the plurality of pairs of wires apart from each other.

12. The communication cable of claim 10, wherein the plurality of support arms are integrally formed with the external jacket.

13. The communication cable of claim 1, wherein the connection part and the support part of each of the plurality of support arms of the external jacket are formed such that the communication cable satisfies a standard of Cat.6A or higher.

14. The communication cable of claim 10, wherein the plurality of support arms comprise four support arms.

15. The communication cable of claim 10, wherein the communication cable satisfies a transmission rate of 10 Gbps or more at a transmission band of 500 MHz or more, and has a diameter of 8.1 mm to 8.5 mm.

16. The communication cable of claim 10, wherein each of the plurality of support arms includes a connection part connected to the inner surface of the external jacket and a support part configured to support the plurality of pairs of wires, wherein the connection part has a width decreased toward the center of the communication cable.

17. The communication cable of claim 10, wherein a plurality of protrusions are formed on the support surface of each of the plurality of support arms to be spaced apart from each other in a widthwise direction of the support surface of each of the plurality of support arms.

18. The communication cable of claim 17, wherein a distance between the protrusions on a central portion of the support surface is greater than distances between the protrusions on edges of the support surface.

19. The communication cable of claim 12, wherein the support surface of each of the plurality of support arms has a circular arc shape.

20. The communication cable of claim 17, wherein the external jacket has a thickness greater than a thickness of protrusions formed on the plurality of support arms.

* * * * *